United States Patent [19]

Moore

[11] 4,059,003

[45] Nov. 22, 1977

[54] PROCESS FOR PRODUCING HEAVY-DUTY HIGH-PRESSURE FERROUS METAL CUP-SHAPED PRODUCTS HAVING A CYLINDRICAL BARREL

[76] Inventor: Charles H. Moore, 645 Matanzas Court, Fort Myers Beach, Fla. 33931

[21] Appl. No.: 644,862

[22] Filed: Dec. 29, 1975

Related U.S. Application Data

[63] Continuation-in-part of Ser. No. 519,044, Oct. 29, 1974, abandoned.

[51] Int. Cl.[2] ..... B21C 23/18; B21C 23/20

[52] U.S. Cl. ..... 72/256; 72/267

[58] Field of Search ..... 72/253, 255, 267, 264, 72/256, 353, 358, 361, 367, 368, 370, 356

[56] References Cited

U.S. PATENT DOCUMENTS

| | | | |
|---|---|---|---|
| 1,082,200 | 12/1913 | Knaebel | 72/267 |
| 2,679,931 | 6/1954 | Cigliano | 72/267 X |
| 2,810,478 | 10/1957 | Sejournet et al. | 72/358 X |

FOREIGN PATENT DOCUMENTS

| | | | |
|---|---|---|---|
| 351,814 | 8/1937 | Italy | 72/358 |

*Primary Examiner*—C.W. Lanham

*Assistant Examiner*—D. M. Gurley

[57] ABSTRACT

Large, heavy-duty, high-pressure resistant cup-shaped ferrous metal industrial products possessing substantially thick-walled cylindrical barrels are forged in such manner as to obtain greatly improved quality, dimensionally, metallurgically and otherwise, by the use in sequence of a combination of metal-forging elements which includes a cylindrical female die member; an annular metal-working and metal-displacing ring having an external diameter which is only slightly less than the bore of the cylindrical female forging die member and an internal diameter which is only slightly greater than the external diameter of a metal-working and; a metal-working and metal-displacing disc which interfits with the annular metal working and metal-displacing ring; a first round forging press follower of a diameter which is adequate to entirely cover the metal-working and metal-displacing disc and a substantial portion of the annular metal-working and metal-displacing ring; and a second round forging press follower of a diameter which is slightly less than the internal diameter of the annular metal-working and metal-displacing ring and therefore covers only the metal-working and metal-displacing disc.

1 Claim, 5 Drawing Figures

THE INVENTION

ERRONEOUS PRIOR ART PRACTICE

THE INVENTION

THE INVENTION

PROCESS FOR PRODUCING HEAVY-DUTY HIGH-PRESSURE FERROUS METAL CUP-SHAPED PRODUCTS HAVING A CYLINDRICAL BARREL

This is a continuation-in-part application of my application Ser. No. 519,044, filed Oct. 29, 1974 entitled "Process For Producing Cup-Shaped Ferrous Metal Products Possessing A Cylindrical Barrel" (now abandoned); and it relates to my application Ser. No. 519,043 entitled "Process of Forging Large Seamless Welding Necks" (now abandoned).

The present invention relates to large cup-shaped ferrous heavy-duty, high-pressure metal products having cylindrical barrel portions which are used on or in connection with industrial pressure vessels of various kinds, including nuclear reactors, etc.

There is considerable demand for cup-shaped fittings for pressure vessels, including pill boxes, welding necks and the like; all of which, in order to be acceptable, must meet certain requirements of strength, etc., as dictated by the various codes as well: as well as rigid dimensional qualities.

As earlier indicated among the advantages which are achieved by the use of the process of the invention is to consistently obtain cup-shaped products of the type described which are possessed of great strength very accurate dimensions, uniform wall-thickness and definitely improved metallurgical properties, due to a very substantial amount of metal-working or kneading of the metal.

Another advantage is that the new process permits the forge shop to use a multitude of billets and scrap of widely varying diameter and both with and without rounded corners. This results in tremendously reduced operating costs.

A further objective is more uniform extrusion and improved grain orientation than can be obtained by the use of prior art methods of producing heavy-duty, high-pressure cup-shaped ferrous metal products of comparable size and weight.

The foregoing and other objects and advantages will be more readily understood from the following description and the annexed drawings, wherein like references represent like parts, and wherein.

Figure 1:
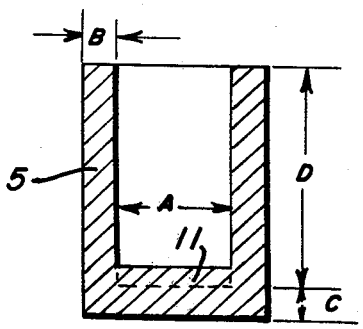
FIG. 1 is a sectional elevation of a typical product which is obtained by the practice of the process of the invention.
Figure 2:
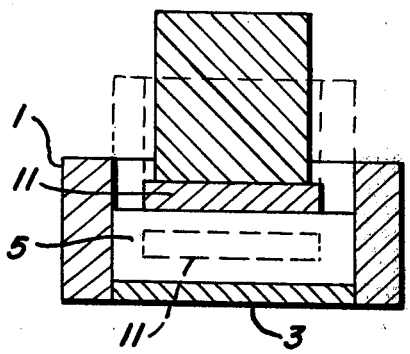
FIG. 2 is a sectional elevational view illustrating certain concentrically disposed basic forging instrumentalities which are employed in the practices of the prior art.
Figure 3:
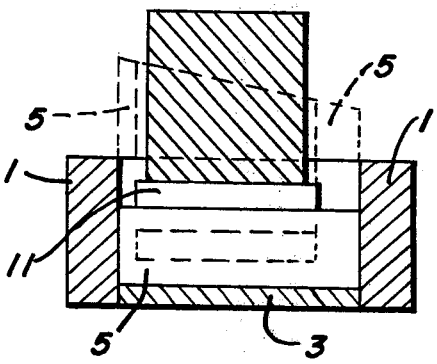
PRIOR ART FIG. 3
FIG. 3 is a view which is similar to that of FIG. 2 but illustrating a very undesirable situation which results from the practice of certain prior art methods represented in FIG. 2, the same being due to misalignments which are completely avoided by the new process.

It is known that in metal-working in general, and light-weight metal-working in particular, back-extrusion of the metal has been proposed for the manufacture of small rings and short sleeve-like articles for one purpose or another; such as piston rings, bearing races and the like; but to what extent, and with what degree of success, is not known.

According to one of the prior art methods of back-extruding to obtain an article having a cylindrical wall, a heated billet is placed in a vertically disposed cylindrical die with a temporarily closed bottom and a round punch moves downwardly on it until the height of the billet is decreased and the metal thereof is forced outwardly into full contact with the adjacent surfaces of the interior of the cylindrical die. A second round punch of smaller diameter than the first is then forced downwardly onto the top of the heated billet, causing the metal thereof to move upwardly between the periphery of the second round punch (of smaller diameter) and the sidewall of the circular forging die. This back-extrusion of the metal of the heated billet is accompanied by a strong tendency on the part of the cylindrical die to move upwardly therewith; and it is therefore essential that the cylindrical forging die be strongly bolted down to the bed of the forging press or machine.

During these steps the bottom of the die is constituted by a circular forging knife or shearing ring which closely surrounds a centrally disposed round metallic plate; both the circular forging knife and the central round metallic plate being supported from below and solidly backed by a retractable metallic disc.

However, it is believed that such practices are non-analogous to the present invention not only in the matter of industrial environment and vast disparity in sizes, etc. but also due to a very important difference in the manner in which the metal is worked during the back-extrusion itself, and the manner in which the billet or work-piece and the handling instrumentalities therefor are manipulated; all of which will be more fully described hereinafter.

In my aforementioned copending patent application Ser. No. 519,043 entitled "Process For Forging Large Seamless Welding Necks", which is related to the present application, the end products are characteristically of very substantial size and weight, comprising, as illustrative embodiments, a manhole size with long barrels weighing approximately 1083 pounds, and, later on in the Specification a Type H Neck for which the starting solid billet or work-piece weighed 2,044 pounds. Wall thicknesses of 3 inches and more are very frequently the case and quite often run to 8 inches or so.

Industrial pill boxes contemplated by the present invention would rarely be under 8 inches in diameter and rarely weigh less than 500 pounds.

The present invention involves starting billets and end products of similar size and weight, or smaller or larger, as the circumstances require.

Referring more particularly to the drawings, the numeral 1 designates the cylindrical female forging die element having a bore of predetermined length and diameter, and at the bottom of which there is a removable metal disc or round plate 3.

The heated work-piece 5 which is placed in the die cavity of the cylindrical female forging die member 1 is a billet of ferrous metal which according to the invention may be square, square with rounded edges, or round; and of lesser diameter than the diameter of the die cavity.

Accordingly, it will be appreciated by those skilled in the art that the process may readily utilize many of the scrap pieces which are found in or nearby the forge shop which are not marketable due to dimensional shortcomings or are otherwise not utilizeable except as scrap; thereby tremendously reducing operating costs.

Next, there is placed on top of the heated work-piece 5 an annular metal-working and metal-displacing ring 22 having an external diameter which is slightly less than the bore of the cylindrical female die member 1 and within this annular metal-working and metal-displacing ring there is positioned a metal working and metal-displacing disc 11 which is fairly closely fitting, and of the same thickness, which may be 3 inches, for example.

Disposed atop both the annular metal-displacing ring 22 and the metal-working and metal-displacing disc 11 is a conventional round forging press follower 23 of a diameter which is less than the diameter of the bore or forging die cavity of the cylindrical female die member 1 but sufficient to adequately cover both the annular metal-working and metal-displacing ring 22 and the metal-working and metal-displacing disc 11.

When the vertically movable upper member, or platen, of the forging press is moved downwardly, the follower 23, which is of slightly lesser diameter than the bore of the cylindrical female forging die member 1, exerts downward forging pressure of tremendous magnitude on both the annular metal-working and metal-displacing ring 22 and the metal-working and metal-displacing disc 11; and as they both continue to descend, the metal of the billet or work-piece spreads out and its entire periphery contacts the wall of the die cavity of the cylindrical female forging die member 1.

The annular metal-working and metal-displacing ring 22, in its metal-working and metal-displacing capacity besides serving to permit the use of billets of much smaller diameter than would otherwise be the case since its periphery very closely approaches the interior surface of the cylindrical female forging die member 1, serves as an accurate centering guide on its inner wall for the periphery of the metal-working and metal-displacing disc 11.

When the metal-working and metal-displacing disc 11 and annular metal-working and metal-displacing ring 22 have been forced downwardly to the point where metal being forged has made full contact with the inner surface of the cylindrical female forging die member 1, the downward movement of the upper and vertically movable platen of the forging press is arrested.

Figure 4:
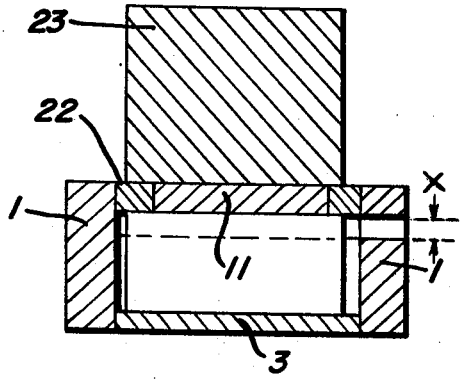
FIGS. 4 and 5 are sectional elevations illustrating the apparatus employed at certain stages of the inventive process, in the latter of which back-extrusion is taking place.
Figure 5:
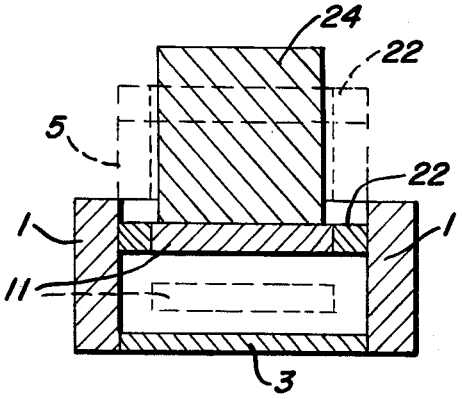

This distance is indicated in the drawings at X in FIG. 4.

When the immediately aforementioned position has been reached the initial round forging press follower 23 is removed, and replaced by a second round follower 24 of a diameter which is slightly less than the internal diameter of the annular metal-working and metal-displacing ring 22.

By this arrangement, the annular metal-working and metal-displacing ring 22 serves as an accurate centering guide for the second round follower 24 of smaller diameter which now rests directly upon the metal-working and metal-displacing disc 11.

At this point, the annular metal-working and metal-displacing ring 22 has completely served its metal-working and metal-displacing function.

As the second round follower 24 moves downwardly by the action of the forging press, the metal-working and metal-displacing disc 11 presses downwardly on the top of the billet therebelow, now independently of the annular metal-working and metal-displacing disc 11. In this manner the metal of the heated billet is displaced upwardly in the cylindrical female forging die member 1 and between its sidewall and the periphery of the annular metal-working and metal-displacing disc 11 which is concentric therewith.

The downward movement of the platen of the forging press and second round follower are discontinued at the point where the metal of the heated work-piece 5 is a minimum distance of approximately 3 inches from the bottom of the die cavity of the cylindrical female forging die member 1, as determined by the position of the metal-working and metal-displacing disc 11 with respect to the underlying removable round disc or bottom closure 3 of the cylindrical female forging die member 1.

The reason for providing for an approximate 3-inch or greater thickness of metal below the metal-working and metal-displacing disc at its designated lowermost point of operation in the bottom of the cylindrical female forging die member during the back-extrusion step as described is that as the metal from inside the billet or work-piece is being displaced, it must move to the outside, and reverse its general direction of movement upwardly between the periphery of the metal-working and metal-displacing disc and the adjacent surface of the sidewall of the cylindrical female forging die member and this thickness is believed minimal.

Such a thickness (approximately 3 inches or more) of metal below the metal-working and metal-displacing disc 11 will involve the following minimum weight as related to the diameter of the cylindrical barrel of the cup-shaped product:

| Diameter of Cylindrical Barrel | Weight of Metal Below the Metal-working and Metal-Displacing Disc at Three-Inch Thickness |
|---|---|
| 14 inches | 122 lbs. |
| 16 inches | 182 lbs. |
| 18 inches | 204 lbs. |
| 20 inches | 254 lbs. |
| 24 inches | 369 lbs. |

and, of course, is reflected in the weight of the metal displacement disc 11 which should, in any event be at least 1½ inches in thickness and preferably considerably more.

Because of the necessity of regulating the process of the invention in order to provide the minimum 3-inch metal displacement described, and to utilize a metal-working and metal-displacing disc of comparable size and weight, it is only applicable to the manufacture of heavy-duty, high-pressure resistant ferrous metal cup-shaped industrial articles of very substantial size and weight, such as are used for Pill Boxes in connection with heat exchange apparatus, the end product of which may weigh anywhere between at least several hundred pounds and several thousand pounds.

The product shown in FIG. 1, with the metal-working and metal-displacing disc 11 still in place, possesses a circular interior cavity A of desired diameter; with corresponding regulated side-wall of uniform wall-thickness B. The height of the product plus the thickness of the metal-working and metal-displacing disc 11 is indicated at D and the thickness of the bottom of the product minus the thickness of the metal displacement disc 11 is indicated at C.

From the foregoing, it will be perceived that the annular metal-working and metal-displacing ring 22 is very essential to the practice of the process of the invention serving as it does to not only permit the processing or metal-working of billets having much lesser diameter than otherwise be the case, but also to 1. accurately center the position of the metal-working and metal-displacing disc 11 on the top of the billet
2. together with the metal-working and metal-displacing disc, in compressing the billet until it makes full contact with the sidewall of the cylindrical female forging die member and
3. accurately center and second round follower 24 (of smaller diameter).

As long known to those who are skilled in the art of back extrusion, with the use of a cylindrical female forging die member 1 there is inescapably bound to be a tendency on the part of said die member to move upwardly with respect to the work-piece; and there are numerous well-known ways of eliminating this problem, such, for example, as the use of a stationary circular integrally-formed ledge on the bottom of the wall of the cylindrical female forging die member which protrudes slightly into the mold cavity, and various hold-down means on the exterior of the cylindrical female forging die member such as bolt and nut arrangements and the like. The present invention is not limited in any way to a particular back-extrusion hold-down means; and accordingly none is described herein nor illustrated in the drawings.

The term "metal-displacing" is used herein in conformity with its well-recognized meaning in the metal-working arts as indicating compression of the metal such as will change the cross-sectional area thereof.

Having thus described the invention, and illustrated on the annexed drawings, what I claim as new and desire to secure by Letters Patent is:

1. The process of forging a large heavy-duty, seamless high-pressure resistant, self-reinforcing cup-shaped ferrous-metal product with a cylindrical barrel of substantial wall-thickness, in a forging press possessing the usual lower stationary element and the usual upper vertically movable element, said process including a. placing on the lower stationary element of the forging press a vertically disposed cylindrical female forging die member having a closed bottom,
b. placing within the vertically disposed cylindrical female forging die member a steel billet heated to forging temperature,
c. placing on top of the heated steel billet an annular billet-contacting metal-working and metal-displacing ring having an external diameter which is slightly less than the diameter of the bore of the cylindrical female forging die member,
d. positioning within the open center of the annular billet-contacting metal-working and metal-displacing ring a billet-contacting metal-working and metal-displacing metallic disc which is fairly closely fitting and of substantially the same thickness as that of the annular billet-contacting metal-working and metal-displacing ring,
e. disposing atop the annular billet-contacting metal-working and metal-displacing ring and the billet-contacting metal-working and metal-displacing metallic disc a round forging press follower of a diameter which is less than the diameter of the die cavity of the cylindrical female forging die member but sufficient to cover both the billet-contacting metal-working and metal-displacing disc and most of the billet-contacting metal-working and metal-displacing annular ring,
f. moving the upper and vertically movable element of the forging press downwardly to thereby press the round forging press follower onto the round billet-contacting metal-working and metal-displacing metallic disc and the billet-contacting metal-working and metal-displacing annular ring and, through said metallic disc and said annular ring, exert forging pressure onto the top of the heated billet, whereby the billet spreads out until the outer periphery thereof makes contact with the inner surface of the die cavity of the cylindrical female forging die member,
g. arresting the downward movement of the upper and vertically movable element of the forging press when the immediately aforementioned condition takes place,
h. removing the aforementioned round forging press follower and replacing it with a second round forging press follower having a diameter that is less than that of the billet-contacting metal-working and metal-displacing disc and which is concentric therewith,
i. applying pressure through the upper and vertically movable element of the forging press to the top of the second-named round forging press follower, whereupon the latter depresses the billet-contacting metal-working and metal-displacing metallic disc, and the metal of the heated billet is caused to move upwardly into the space between the periphery of the billet-contacting metal-working and metal-displacing metallic disc and the inner surface of the die cavity of the cylindrical forging die member during which the billet-contacting annular metal-working and metal-displacing annular ring moves upwardly on top of the back-extruded metal,
j. continuing the immediately aforementioned movements until the metal of the heated work-piece below the billet-contacting metal-working and metal-displacing metallic disc is no less than approximately three inches thick and at which time the bottom of the round metal-working and metal-displacing disc will have become welded to the metal of the highly heated billet with which it is in contact,
k. removing the billet-contacting metal-working and metal-displacing annular ring from the top of the back-extruded work-piece formed of said heated billet and,
l. removing the work-piece formed from the vertically disposed cylindrical female forging die member.

* * * * *